US005870781A

United States Patent [19]

Williams

[11] Patent Number: 5,870,781

[45] Date of Patent: Feb. 16, 1999

[54] ADJUSTABLE SHOWER TRACK SYSTEM

[76] Inventor: Alex Williams, 1881 Ivy Hall Rd., Charleston, S.C. 29407

[21] Appl. No.: 884,563

[22] Filed: Jun. 27, 1997

[51] Int. Cl.[6] ..... A47K 3/22

[52] U.S. Cl. ..... 4/605; 4/615

[58] Field of Search ..... 4/615, 605

[56] References Cited

U.S. PATENT DOCUMENTS

| | | | |
|---|---|---|---|
| D. 294,286 | 2/1988 | Fabian | D23/213 |
| 2,685,093 | 8/1954 | Lundquist | 4/615 |
| 3,005,995 | 10/1961 | Bickford | 4/615 |
| 3,404,410 | 10/1968 | Sumida | 4/615 |
| 3,737,107 | 6/1973 | Wright | 4/615 X |
| 3,806,963 | 4/1974 | Flynn | 4/615 |
| 3,865,310 | 2/1975 | Elkins et al. | 4/615 X |
| 3,979,096 | 9/1976 | Zieger | 4/615 X |
| 4,174,822 | 11/1979 | Larsson | 4/615 X |
| 4,271,543 | 6/1981 | Martin | 4/615 |
| 4,339,833 | 7/1982 | Mandell | 4/542 |
| 4,360,159 | 11/1982 | Haynes | 4/605 X |
| 4,561,136 | 12/1985 | Baer | 4/615 |
| 4,881,282 | 11/1989 | George et al. | 4/604 |
| 4,914,759 | 4/1990 | Goff | 4/605 |
| 4,964,573 | 10/1990 | Lipski | 4/615 X |
| 5,035,010 | 7/1991 | Sakamoto et al. | 4/615 X |

FOREIGN PATENT DOCUMENTS

| | | | |
|---|---|---|---|
| 2380009 | 10/1978 | France | 4/615 |
| 336845 | 10/1989 | France | 4/615 |
| 2644813 | 9/1990 | France | 4/615 |
| 92021829 | 12/1992 | France | 4/605 |
| 1962627 | 7/1970 | Germany | 4/615 |
| 406062971 | 3/1994 | Japan | 4/605 |
| 2220567 | 1/1990 | United Kingdom | 4/615 |

*Primary Examiner*—David J. Walczak
*Assistant Examiner*—Kathleen J. Prunner
*Attorney, Agent, or Firm*—The Harleston Law Firm; Kathleen M. Harleston

[57] ABSTRACT

An adjustable shower track system which allows an user to movably position a shower head at varying locations along a longitudinal slot within a housing front wall is provided. The adjustable shower track system has a hose which has: a hose first connector attached at one distal end and is removably attachable to a standard shower spout; and a hose second connector attached at an opposite distal end. The system further comprises a shower head connector which has a connector handle holder having an internal opening substantially larger than an outer diameter of the hose and hose second connector which is movably positioned therethrough. The connector handle holder functions to removably secure the handle therein and further functions as a guide for the hose which is movably mounted therethrough. The shower head connector also comprises a connector hinge which is connected to a movable means, such as a belt, which allows a user to position the shower head at varying heights within the longitudinal slot in the front of the housing.

17 Claims, 9 Drawing Sheets

ADJUSTABLE SHOWER TRACK SYSTEM

BACKGROUND OF THE INVENTION

1. Technical Field

The present invention relates to an adjustable shower track system. More particularly, the present invention relates to an adjustable shower track system which allows an user to movably position a shower head at varying locations along a longitudinal slot within a housing front wall.

2. Background of the Invention

Time spent in the shower seems to encourage creativity as shower heads and shower track systems have been the subject of inventions for years. The prior art, for example, discloses shower heads which are at a single fixed height and therefore do not accommodate for different sized persons. The prior art discloses ball and socket pivotal shower heads and chain adjustable shower heads, among other things. Shower heads with water flow regulators are also known.

The prior art, though, does not address the long felt need for a retrofittable shower height adjuster, which allows a user to movably position a shower head at varying locations within a longitudinal slot in the shower track housing, or to remove the shower head from the stationery position and direct the shower flow using one hand. This type of shower track system allows pressurized water to hit upper or lower extremities of the body during the shower, resulting in increased blood circulation. It also facilitates cleaning of the shower stall afterwards.

SUMMARY OF THE INVENTION

The present invention relates to an adjustable shower track system which allows a user to movably position a shower head at varying locations within a slot longitudinally disposed within a housing front wall. The system can be attached to a wall of a standard shower stall or built into a shower wall. The shower head raises or lowers depending on the users height and/or need to adjust the shower of water to a specific level. The shower head has many differing functions such as variation in water pressure, rotation with adjustment capability at different angles, telescopic function, and removableness from the connector handle holder. The shower head itself preferably comprises a flow regulator device so that the user can adjust the shower flow, or convert the shower to a faucet-like flow.

BRIEF DESCRIPTION OF THE DRAWING

A more complete understanding of the invention and its advantages will be apparent from the following Description of the Preferred Embodiment(s) taken in conjunction with the accompanying drawings, wherein.

DESCRIPTION OF THE PREFERRED EMBODIMENTS

Figure 1:
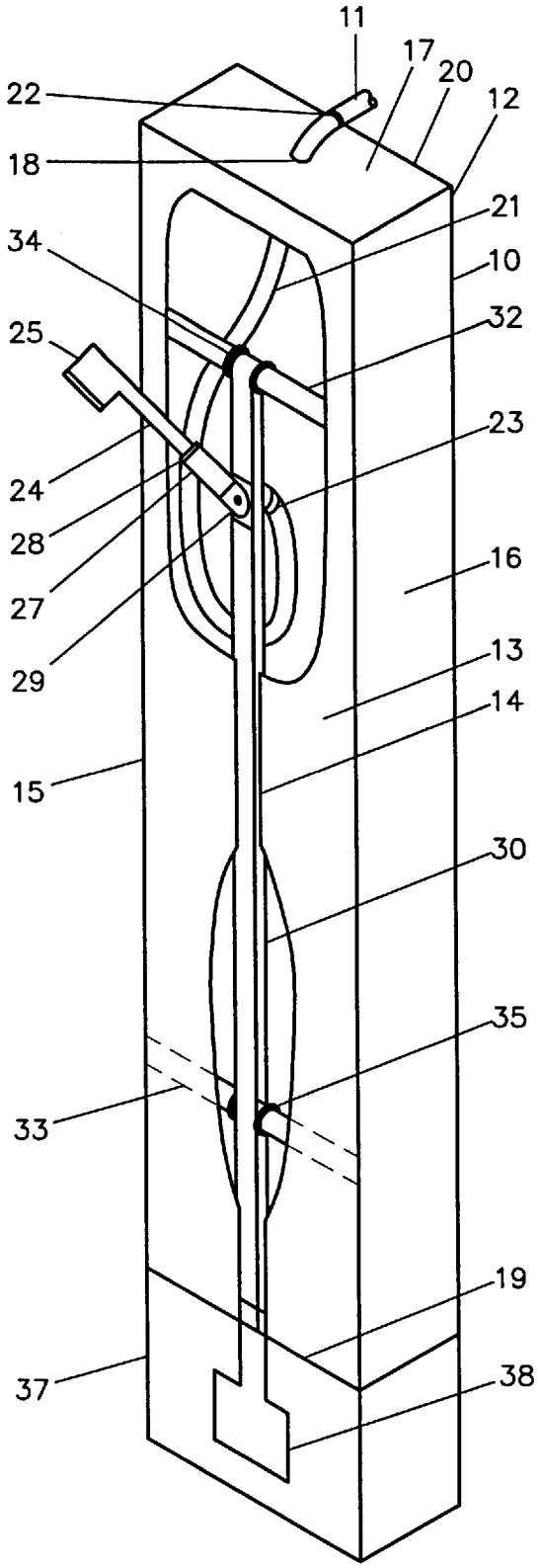
FIG. 1 is a perspective view of an adjustable shower track system constructed in accordance with the present invention.

In the following description, like reference characters designate like or corresponding parts throughout the several views. Referring in more detail to the drawings, the invention will now be described.

First, there is illustrated in FIG. 1 a perspective view of an adjustable shower track system, which is constructed in accordance with the present invention, and is generally designated by the reference character 10. This adjustable shower track system 10 is removably attachable to a standard shower spout 11. The nonmotorized (not motor-driven) adjustable shower track system 10 comprises a housing 12 configured as a box which comprises a housing front wall 13 having a housing front slot 14 longitudinally disposed therein, a housing left wall 15, a housing right wall 16, a housing top 17 having a housing top opening 18, a housing bottom 19, and a housing rear wall 20.

The adjustable shower track system 10 further comprises a hose 21 which comprises a hose first connector 22, the hose first connector 22 being attached at one distal end of the hose 21 and being removably attachable to the standard shower spout 11. The hose 21 further comprises a hose second connector 23, which is attached at an opposite distal end of the hose 21.

The adjustable shower track system 10 further comprises a handle 24, which is connected at a lower distal end to the hose second connector 23. The adjustable shower track system 10 further comprises a shower head 25, which is connected to the handle 24. Generally, the hose 21 passes from the standard shower spout 11 through the housing top opening 18 and down to the shower head unit, as shown in FIG. 1. When the water is turned on via the hot/cold knob, the water comes from the standard shower spout 11 (or other means of attachment to the water supply line) through the hose 21, eventually emerging in a spray from the shower head 25.

The adjustable shower track system 10 further comprises a connector handle holder 27 having an internal opening slightly larger than an outer diameter of the handle 24. The internal opening of the connector handle holder 27 is also substantially larger than an outer diameter of the hose 21 and hose second connector 23 which is movably positioned therethrough. The connector handle holder 27 functions to removably secure the handle 24 therein and further functions as a guide for the hose 21, which is movably mounted therethrough.

Figure 2:
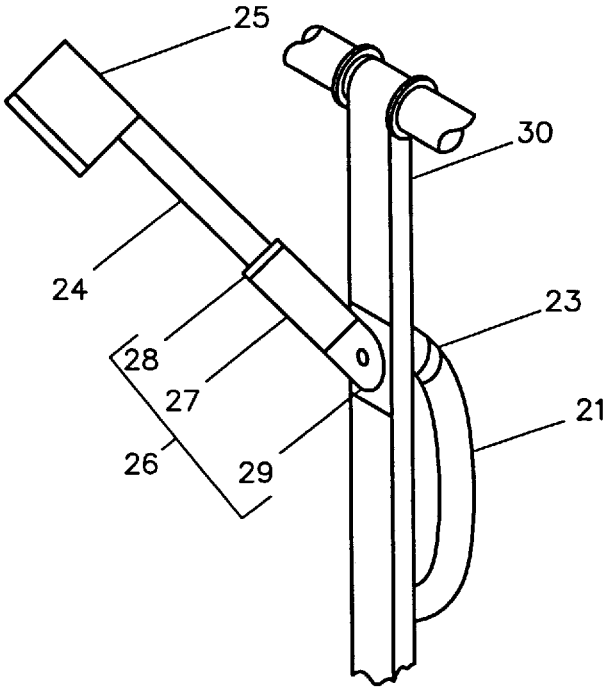
FIG. 2 is a side perspective view of the shower head unit from the adjustable shower track system shown in FIG. 1, which exhibits the shower head, handle, shower head connector, belt, and hose.

The items which make up the shower head unit are shown in FIG. 1 and FIG. 2. FIG. 2 is a side view of the shower head unit from an adjustable shower track system of the present invention showing the shower head 25, handle 24, shower head connector 26, belt 30, and hose 21. The adjustable shower track system 10 comprises a movable means, preferably a belt 30, attached to a shower head connector 26 which functions to allow an user to movably position the shower head connector 26 at varying heights within the housing front slot 14. The shower head connector 26 comprises a connector hinge 29, as well as a connector handle holder 27. The shower head unit comprises the shower head 25, handle 24, and the connector handle holder 27. The connector hinge 29 is securely attached to the belt 30. The handle 24 is positioned within and extends through the connector handle holder 27. The connector handle holder 27 comprises a connector handle holder locking means 28 positioned at an outer distal end. The connector handle holder locking means 28 functions to adjust removableness tension on the handle 24 which is positioned therethrough. The handle 24 and shower head 25 can thus be telescoped in or out and locked into place at the desired position. Also, the shower head unit can be removed by the user from the connector hinge 29 and pulled away from the rest of the system 10, though still attached to the hose 21, for use in other parts of the shower. This option is useful, for example, for cleaning the shower.

Figure 3:
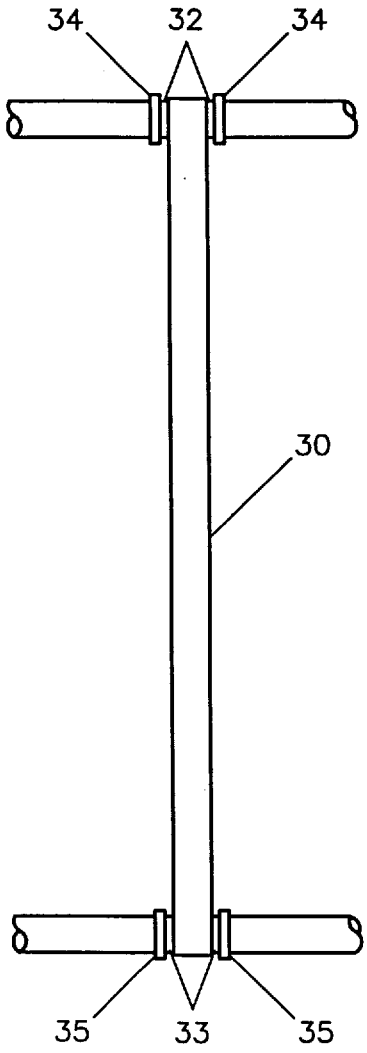
FIG. 3 is a front plan view of the belt pulley system from the adjustable shower track system of FIG. 1, showing a belt movably connected at a top distal end to a belt upper pulley and movably connected at a bottom distal end to a belt lower pulley.

FIG. 3 is a front plan view of a portion of the adjustable shower track system of FIG. 1. FIG. 3 shows a front view of the belt pulley system from FIG. 1. The belt 30 is movably connected at a top distal end to a belt upper pulley 32 and movably connected at a bottom distal end to a belt lower pulley 33. The belt upper pulley 32 further comprises a belt upper pulley aligner 34 which functions to maintain the belt 30 in alignment with the belt lower pulley 33. The belt lower pulley 33 further comprises a belt lower pulley aligner 35 which functions to maintain the belt 30 in alignment with the belt upper pulley 32.

As shown in FIG. 1, a connector hinge 29 is securely attached to the belt 30. A handle 24 is positioned through a connector handle holder 27 and is connected to a hose 21 by a hose second connector 23. The movable means is preferably a belt 30 which is looped around the belt upper pulley 32 and the belt lower pulley 33, as is also shown in FIG. 3.

Figure 4:
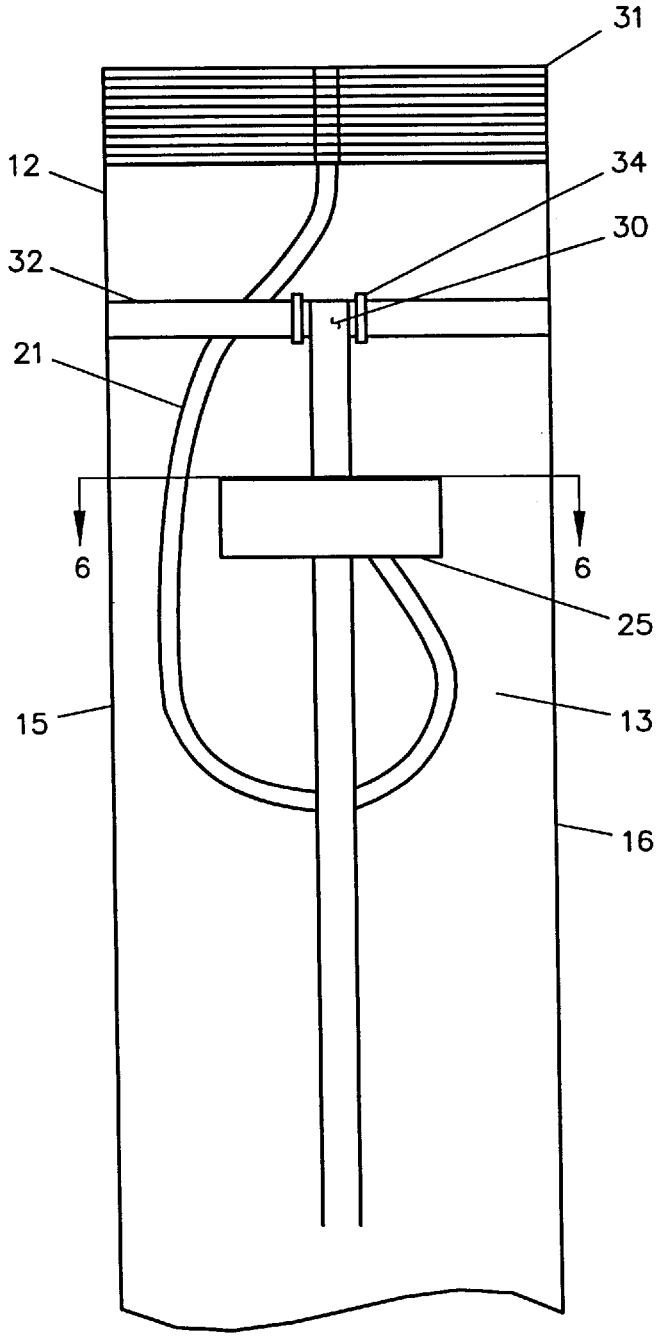
FIG. 4 is a front view of an upper portion of the adjustable shower track system of FIG. 1, which exhibits a housing cover mounted thereon.

FIG. 4 shows a front view of an upper portion of an adjustable shower track system 10 exhibiting a housing cover 31 mounted thereon. This figure shows the center of the adjustable shower track system 10 from FIG. 1, including the belt upper pulley 32.

Figure 5:
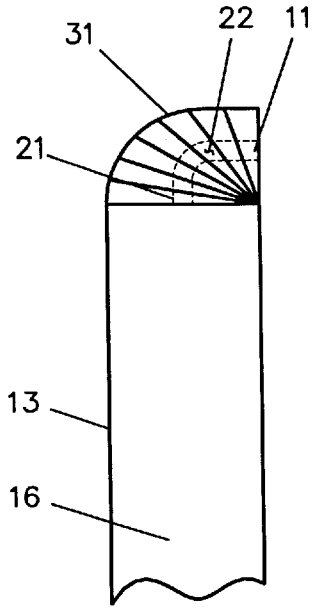
FIG. 5 is a right side view of part of the top of the adjustable shower track system shown in FIG. 4, which shows the housing cover mounted thereon.

FIG. 5 is a right side partial view of the top of the adjustable shower track system 10 shown in FIG. 4, which exhibits the housing cover 31 and the housing right wall 16. As is shown in this view of the system 10 from the side, the housing cover 31 preferably curves down in front. The housing cover 31 serves to cover the standard shower spout 11, the hose 21, and the hose first connector 22.

Figure 6:
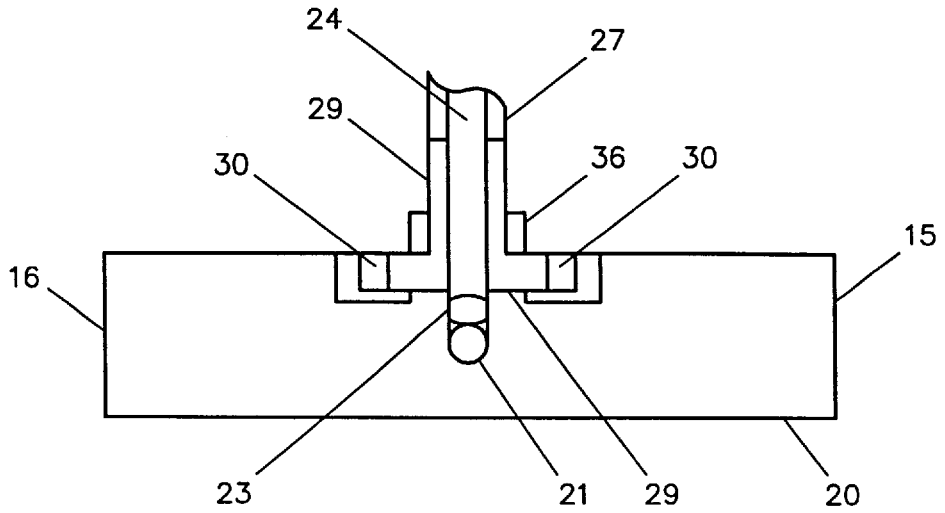
FIG. 6 is a cross-sectional view along line 6—6 of FIG. 4, and exhibits a belt tension adjuster movably positioned on a connector hinge.

FIG. 6, which is a cross-sectional view along line 6—6 of FIG. 4, exhibits a belt tension adjuster 36 movably positioned on the connector hinge 29. The belt 30 comprises the belt tension adjuster 36. When the user tightens the belt tension adjuster 36, the connector hinge 29 is moved outwardly. Concurrently, the belt 30 is moved outwardly which frictionally contacts an inside surface of the housing front wall 13 thereby holding the connector handle holder 27, handle 24, and shower head 25 in a fixed position along the housing front slot 14.

Figure 7:
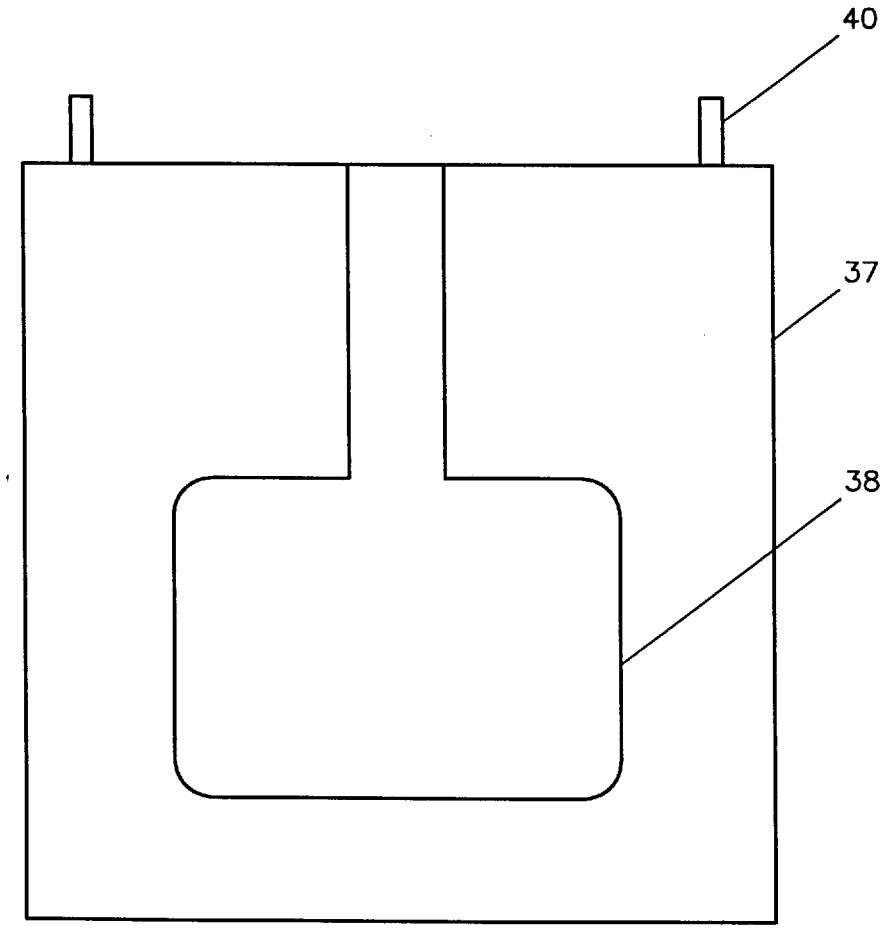
FIG. 7 is a front view of a shower head holder from an adjustable shower track system constructed in accordance with the present invention.

FIG. 7 is a front view of a shower head storage holder 37 from an adjustable shower track system constructed in accordance with the present invention. FIG. 1 shows an example of an optional, detachable shower head storage holder 37. The shower head storage holder 37 can be adhered or affixed to the housing bottom 19. Attachment means 40, such as pegs or snaps or adhesive, can be used. The shower head storage holder 37 is preferably of approximately the same width and depth as the housing 12, so that there is a clean line and good fit between the shower head storage holder 37 and the housing 12. The shower head storage holder 37 comprises a shower head cradle 38, which is of a sufficient size to accommodate and hold the shower head 25 and its attached handle 24. The shower head 25 is removably positionable within the shower head storage holder 37. The bottom of the shower head storage holder 37 is preferably perforated to allow the escape of any trickle of water from the shower head 25 after its use. The shower head 25 is preferably placed in the shower head storage holder 37 to present a neat appearance and as a safety measure (e.g. less to bump into in the shower and less temptation for a child when the shower head and handle are put away.)

Figure 8:
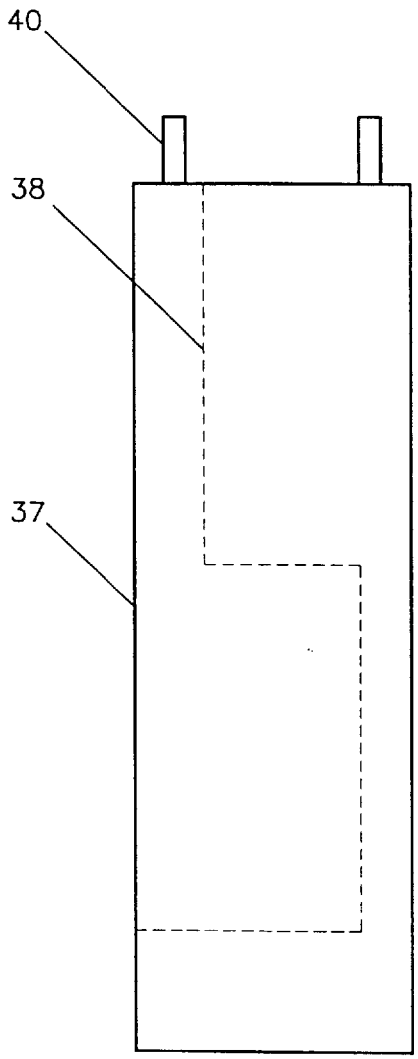
FIG. 8 is a side view of the shower head holder shown in FIG. 7.

FIG. 8 is a side view of the shower head storage holder 37 shown in FIG. 7. The shower head cradle 38 is in the center portion of the shower head storage holder 37. Attachment means 40 are shown at the top of the shower head storage holder 37. Examples of attachment means 40 include waterproof pegs, snaps, or appropriate adhesives. Any suitable attachment means may be employed.

Figure 9:
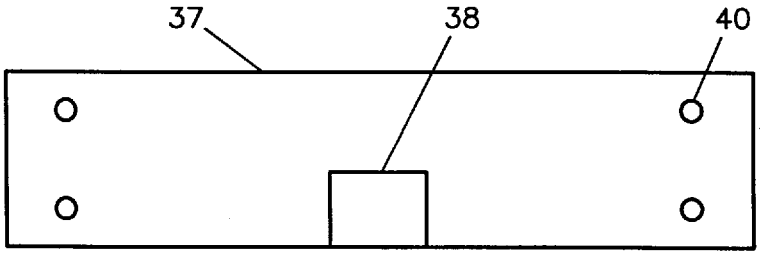
FIG. 9 is a top view of the shower head holder shown in FIGS. 7 and 8.

FIG. 9 is a top view of the shower head storage holder 37 shown in FIGS. 7 and 8. The shower head cradle 38 is shown in the center of the front of the shower head storage holder 37. Four attachment means 40 are shown. If pegs were used as the attachment means, for example, the housing bottom 19 would comprise openings to accommodate the pegs.

Figure 10:
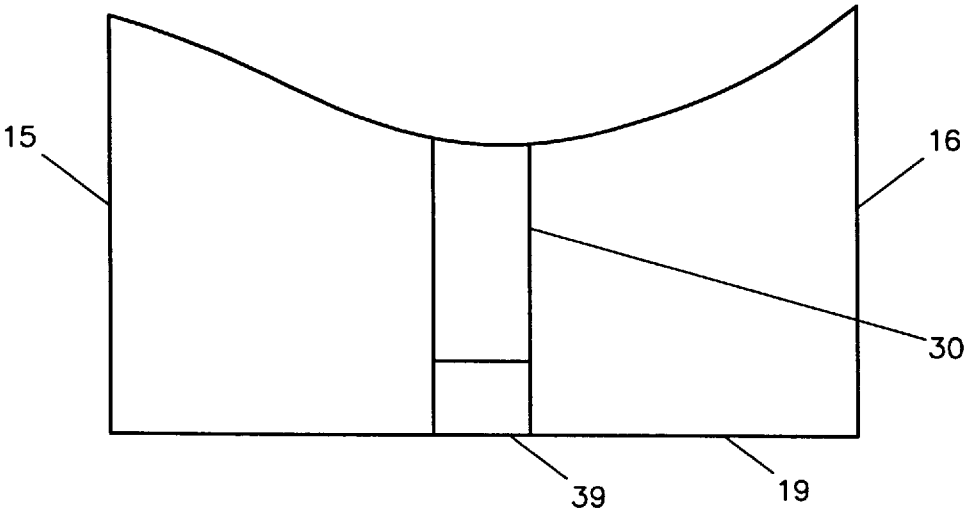
FIG. 10 is a front view of the bottom portion of an adjustable shower track system according to FIG. 1, showing a slot cover.

FIG. 10 is a front view of the bottom portion of an adjustable shower track system 10 according to FIG. 1, showing a slot cover 39. When the shower head storage holder 37 is not in place on the adjustable shower track system 10, there is an open slot where the end portion of the handle 24 would go if the shower head storage holder 37 was in place. To cover this open slot, a slot cover 39 can optionally be used.

Figure 11:
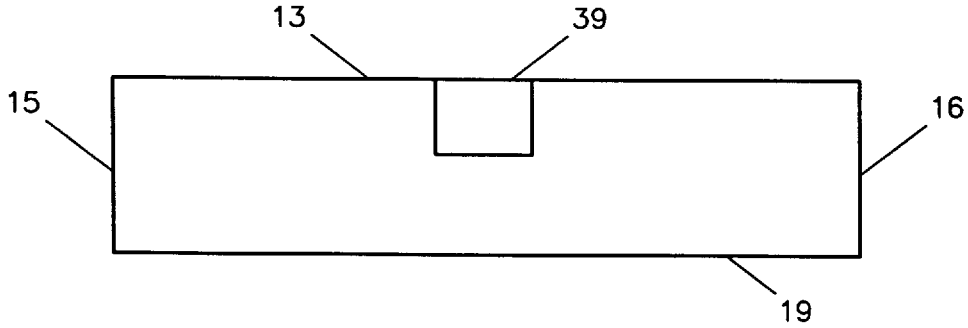
FIG. 11 is a bottom view of the lower portion of the adjustable shower track system shown in FIG. 10.

FIG. 11 is a bottom view of the bottom portion of the adjustable shower track system 10 shown in FIG. 10. The slot cover 39 is shown. The housing bottom 19 is optionally perforated to allow residual water to escape the system 10.

Figure 12:
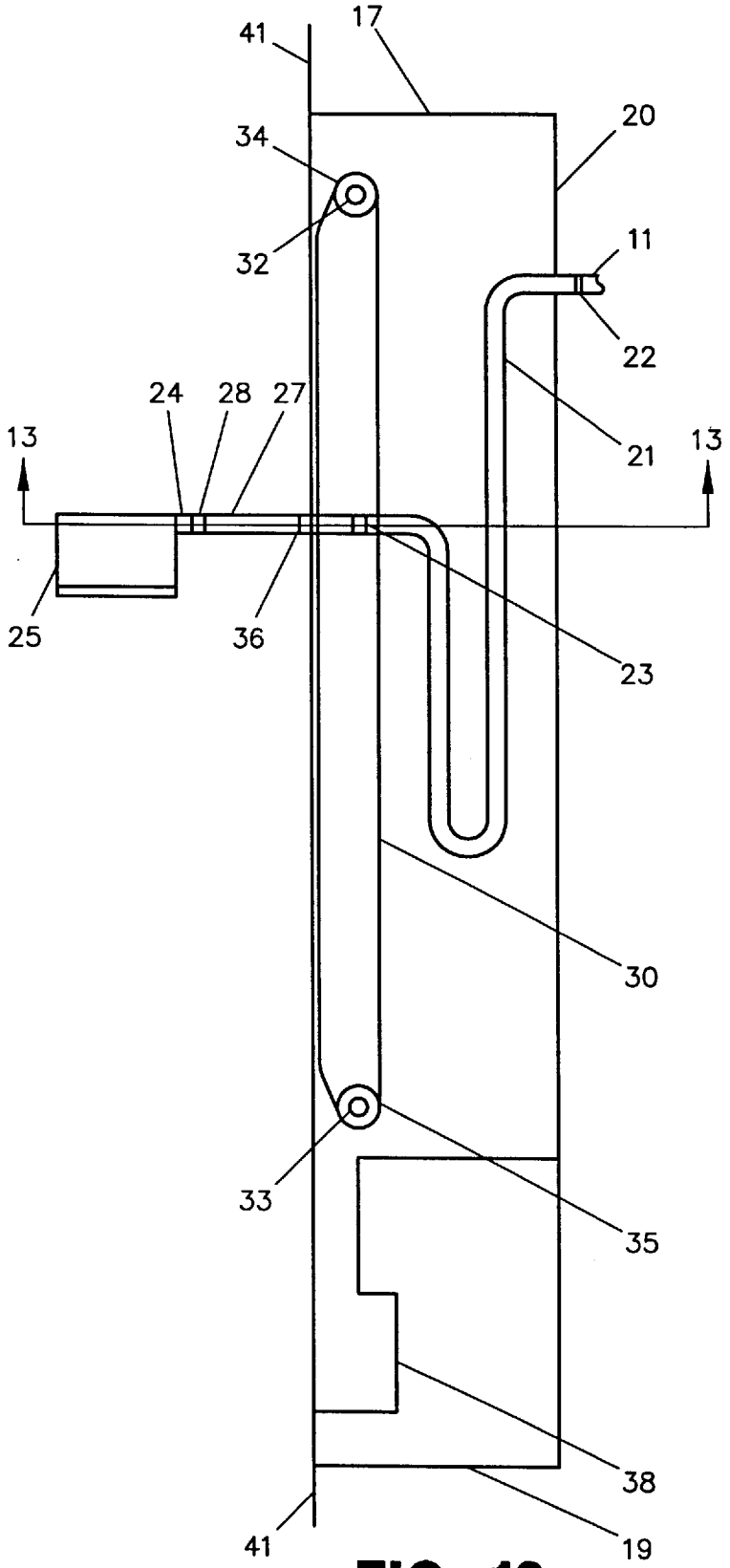
FIG. 12 is a side view of an alternative embodiment of an adjustable shower track system constructed in accordance with the present invention.

FIG. 12 is a side view of an alternative embodiment of an adjustable shower track system 10 constructed in accordance with the present invention. This system 10 is built into a wall of a standard shower stall rather than being placed against the surface of the shower wall. An alternative is where the system is removably attachable to the standard shower spout, and the system is mountable onto a standard shower stall. The latter "exterior" adjustable shower track system 10 is shown in FIG. 1. The adjustable shower track system 10 of FIG. 12 has optional flanges 41, which extend a short distance over the outside edge of the wall for a smooth appearance and better fit. Otherwise, the system operates like the system 10 described in FIGS. 1–6. The belt 30 rotates around the belt upper 32 and lower 33 pulleys. The belt upper and lower pulleys rotate when the shower head 25 moves up or down. This FIG. 12 embodiment illustrates another alternative: building the shower head cradle 38 into the bottom portion of the system 10 rather than having a separate, detachable shower head holder 37. The optional, detachable shower head holder 37, which is less feasible where the system 10 is built-in, is shown in FIGS. 1 and 7–9. The hose 21 in this alternative embodiment extends from the housing rear wall 20 via a housing rear opening (not shown). The hose 21 could as easily extend through the housing top 17 via a housing top opening 18, as in FIG. 1. Note that no housing cover 31 is necessary, because system 10 in FIG. 12 is built-in.

Figure 13:
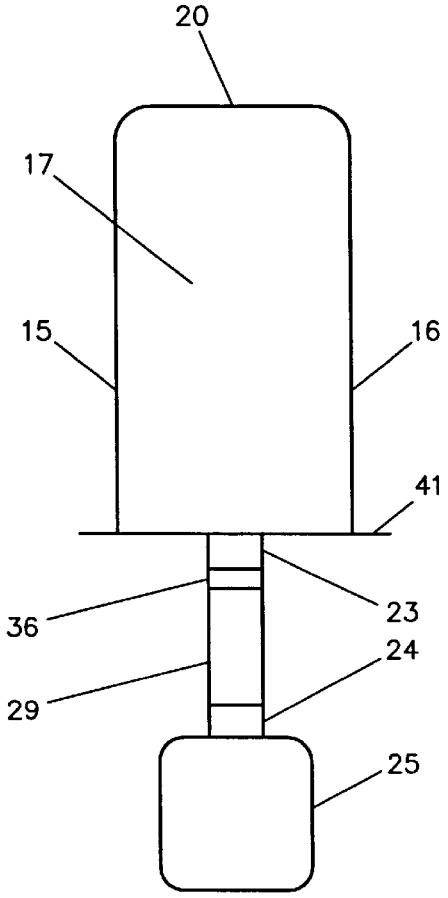
FIG. 13 is a cross-sectional top view, taken along line 13—13 of FIG. 12, and showing the shower head, handle, and housing.

FIG. 13 is a cross-sectional top view, taken along line 13—13 of FIG. 12, and showing the shower head 25, handle 24, and housing. For the purpose of this figure, the shower head 25 and handle 24 in FIG. 12 is shown extending from the housing at an approximately 90 degree angle. It is preferred, though, that the shower head 25/handle 24 extend upward (i.e. approximately a 45 degree angle from the wall at the top) when secured, rather than outward, for a better shower spray.

Figure 14:
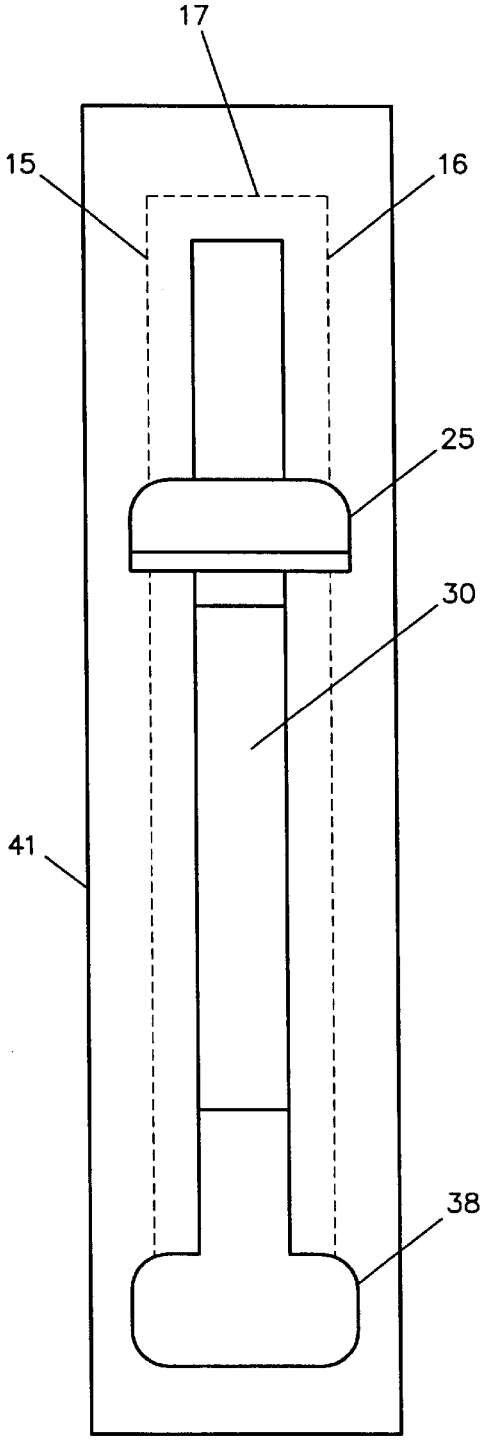
FIG. 14 is a front view of the adjustable shower track system shown in FIG. 12.

FIG. 14 is a front view of the adjustable shower track system 10 shown in FIG. 12. The shower head 25, belt 30, and shower head cradle 38 are shown, as are the housing faces 15–17 and flanges 41.

Figure 15:
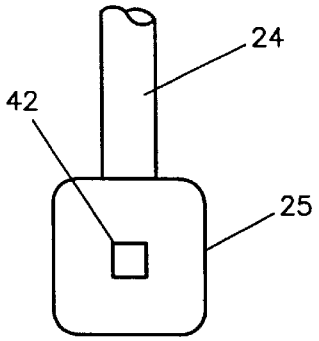
FIG. 15 shows an alternative embodiment of the shower head from an adjustable shower track system according to the present invention.

FIG. 15 is an alternative embodiment of the shower head 25 from an adjustable shower track system 10 according to the present invention. The shower head 25 comprises a flow regulating device 42, such as a device which is movably attached to the face of the shower head 25, for switching the flow of water between types of sprays (such a strong, fine or pulsating spray), and/or from a shower spray to a faucet-like flow. This alternative shower head can be used on built-in or exterior adjustable shower track systems of the present invention.

The present invention preferably comprises more than one elongated member, which allows for telescopic and/or removableness capability (rather than elastic capability). The present invention provides for a telescopic and/or removable means to be adapted to the existing shower arm for adjusting the angle and/or length of the shower head arm. The present invention provides this additional extendible apparatus for adjusting the height and angle of the shower head. The present shower head can be removed from the shower arm and positioned away from the shower wall, according to the user's preference.

The present invention is not designed as a massage apparatus for use in a water bed or similar device. It does not utilize any chains in order to allow for adjustment of the shower head. It preferably does not comprise a ball and socket mechanism for mounting and pivotal adjustment of the shower head. It preferably does not include an additional joystick assembly to control the angle at which the shower head is positioned.

From the foregoing it can be realized that the described adjustable shower track system of the present invention may be easily and conveniently installed and utilized with a minimum of difficulty by homeowners, contractors, and others. These adjustable shower track systems are considered to answer a need for a shower track system which allows the height and angle of the shower head to be adjusted, and which allows the shower head to be removed from the shower arm and positioned away from the shower wall, according to the user's preference.

It will be understood that each of the elements described above, or two or more together, may also find a useful application in other types of constructions differing from the type described above. The invention has been illustrated and described as embodied in an adjustable shower track system, it is not intended to be limited to the details shown, since it will be understood that various omissions, modifications, substitutions and changes in the forms and details of the device illustrated and in its operation can be made by those skilled in the art without departing in any way from the spirit of the present invention.

What is claimed is:

1. A nonmotorized adjustable shower track system attachable to a standard shower spout, the adjustable shower track system comprising:

a) a housing configured as a box which comprises a housing front wall having a housing front slot longitudinally disposed therein;

b) a hose comprising a hose first connector which is attached to the hose at one distal end and is removably attachable to the standard shower spout, and a hose second connector which is attached to the hose at an opposite distal end;

c) a handle connected at a lower distal end to the hose second connector;

d) a shower head connected to the handle and to the hose;

e) a shower head connector which comprises a connector handle holder having an internal opening slightly larger than an outer diameter of the handle, the internal opening being substantially larger than an outer diameter of the hose and hose second connector which is movably positioned therethrough, and the connector handle holder functions to removably secure the handle therein and further functions as a guide for the hose which is movably mounted therethrough; and f) a movable means attached to the shower head connector which functions to allow a user to movably position the shower head at varying heights within the housing front slot.

2. The adjustable shower track system as described in claim 1, wherein the adjustable shower track system is built into a wall of a standard shower stall.

3. The adjustable shower track system as described in claim 1, wherein the system is removably attachable to the standard shower spout, and the system is mountable onto a standard shower stall.

4. The adjustable shower track system as described in claim 3, wherein the housing further comprises a removable housing cover.

5. The adjustable shower track system as described in claim 3, wherein the housing further comprises a housing left wall, a housing right wall, a housing top having a housing top opening, a housing bottom, and a housing rear wall, and wherein the hose passes through the housing top opening.

6. The adjustable shower track system as described in claim 5, wherein the shower head holder is mountable onto the housing.

7. The adjustable shower track system as described in claim 5, wherein the connector handle holder comprises a connector handle holder locking means positioned at an outer distal end, and the connector handle holder locking means functions to adjust removableness tension on the handle which is positioned therethrough.

8. The adjustable shower track system as described in claim 7, wherein the shower head connector further comprises a connector hinge which is adjacent to the connector handle holder and is mounted onto the movable means.

9. The adjustable shower track system as described in claim 8, wherein the movable means is a belt which is looped around a belt upper pulley and a belt lower pulley, and the connector hinge is securely mounted on the belt.

10. The adjustable shower track system as described in claim 9, wherein the belt upper pulley further comprises a belt upper pulley aligner which functions to maintain the belt in alignment with the belt lower pulley.

11. The adjustable shower track system as described in claim 10, wherein the belt lower pulley further comprises a belt lower pulley aligner which functions to maintain the belt in alignment with the belt upper pulley.

12. The adjustable shower track system as described in claim 11, wherein the belt further comprises a belt tension adjuster which is positioned on the connector hinge.

13. The adjustable shower track system as described in claim 12, wherein the shower head comprises a flow regulating device.

14. A nonmotorized adjustable shower track system attachable to a standard shower spout, the adjustable shower track system comprising:

a) a housing configured as a box which comprises a housing front wall having a housing front slot longitudinally disposed therein;

b) a hose comprising a hose first connector which is attached to the hose at one distal end and is removably attachable to the standard shower spout, and a hose second connector which is attached to the hose at an opposite distal end;

c) a handle connected at a lower distal end to the hose second connector;

d) a shower head connected to the handle and to the hose;

e) a shower head connector which comprises a connector handle holder having an internal opening slightly larger than an outer diameter of the handle, the internal opening being substantially larger than an outer diameter of the hose and hose second connector which is movably positioned therethrough, and the connector handle holder functions to removably secure the handle therein and further functions as a guide for the hose which is movably mounted therethrough; and f) a belt looped around a belt upper pulley and a belt lower pulley, the belt being attached to the shower head connector and functioning to allow a user to movably position the shower head at varying heights within the housing front slot; and wherein the shower head connector further comprises a connector hinge which is adjacent to the connector handle holder and is mounted on the belt; and wherein the belt further comprises a belt tension adjuster movably positioned on the connector hinge.

15. The adjustable shower track system as described in claim 14, wherein the shower head comprises a flow regulating device.

16. The adjustable shower track system as described in claim 14, wherein:

a) the adjustable shower track system is removably attachable to the standard shower spout, and is mountable onto a standard shower stall;

b) the housing further comprises a housing left wall, a housing right wall, a housing top having a housing top opening, a housing bottom, and a housing rear wall, and wherein the hose passes through the housing top opening;

c) wherein the connector handle holder comprises a connector handle holder locking means positioned at an outer distal end, and the connector handle holder locking means functions to adjust removableness tension on the handle which is positioned therethrough;

d) wherein the belt upper pulley further comprises a belt upper pulley aligner which functions to maintain the belt in alignment with the belt lower pulley; and e) wherein the belt lower pulley further comprises a belt lower pulley aligner which functions to maintain the belt in alignment with the belt upper pulley.

17. The adjustable shower track system as described in claim 16, wherein the hose at the distal end passes from the standard shower spout through the housing top opening and down to the shower head.

* * * * *